US005430275A

United States Patent [19]

Braunisch

[11] Patent Number: 5,430,275

[45] Date of Patent: Jul. 4, 1995

[54] MICROWAVE OVEN WITH TURNTABLE AND WEIGHT SENSOR

[75] Inventor: Eckart Braunisch, Kimstad, Sweden

[73] Assignee: Whirlpool Europe B.V., Veldhoven, Netherlands

[21] Appl. No.: 189,566

[22] Filed: Jan. 28, 1994

[30] Foreign Application Priority Data

Jan. 29, 1993 [SE] Sweden ..... 9300291

[51] Int. Cl.[6] ..... H05B 6/68

[52] U.S. Cl. ..... 219/708; 219/518; 177/208

[58] Field of Search ..... 219/708, 516; 177/208, 177/254, 209, 141, 132

[56] References Cited

U.S. PATENT DOCUMENTS

| | | | |
|---|---|---|---|
| 1,232,983 | 7/1917 | Schenk | 177/208 |
| 4,219,090 | 8/1980 | Dayton | 177/208 |
| 4,615,405 | 10/1986 | Morino et al. | 219/708 |
| 4,895,067 | 1/1990 | Ohji et al. | 99/325 |
| 5,129,472 | 7/1992 | Du et al. | 177/208 |

FOREIGN PATENT DOCUMENTS

| | | | |
|---|---|---|---|
| 3541791 | 6/1986 | European Pat. Off. | F24C 7/02 |
| 0359976 | 8/1989 | European Pat. Off. | F24C 7/08 |
| 62-59315 | 3/1987 | Japan | F24C 7/08 |
| 3-17426 | 1/1990 | Japan | 219/708 |

*Primary Examiner*—Philip H. Leung
*Attorney, Agent, or Firm*—Robert O. Rice

[57] ABSTRACT

A microwave oven is provided with a weighing device comprising a plate having a vertically movable shaft, and a fluid-containing bladder or a fluid-containing piston and cylinder assembly, and a pressure sensor for sensing the weight of a food product to be cooked in the oven. The problem residing in that the electronic components included in prior-art weighing devices are placed in an unsuitable environment under the cavity bottom of the oven is solved by placing the electronic components on a circuit board for the remaining control electronics in a space separate from the space under the cavity bottom. This solution means that the vertically movable shaft generates a pressure change in the bladder or the piston and cylinder assembly. This pressure change is transmitted to the pressure sensor, which generates a weight-indicating signal.

7 Claims, 1 Drawing Sheet

FIG. 1
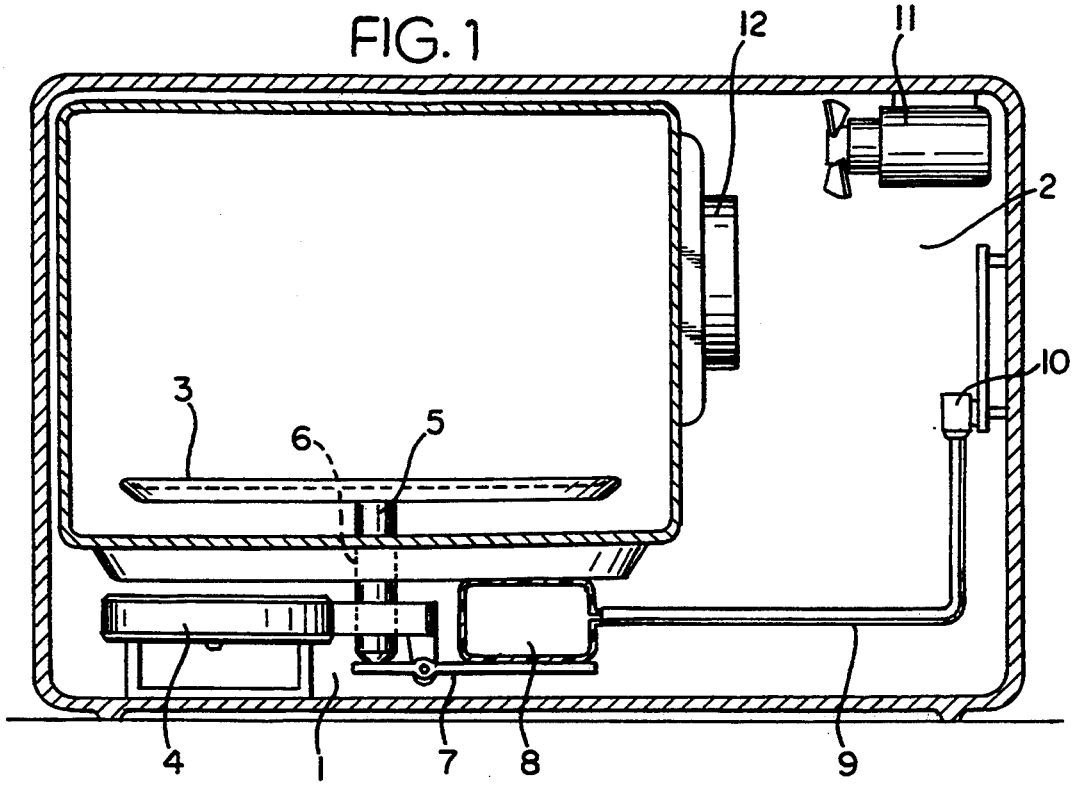
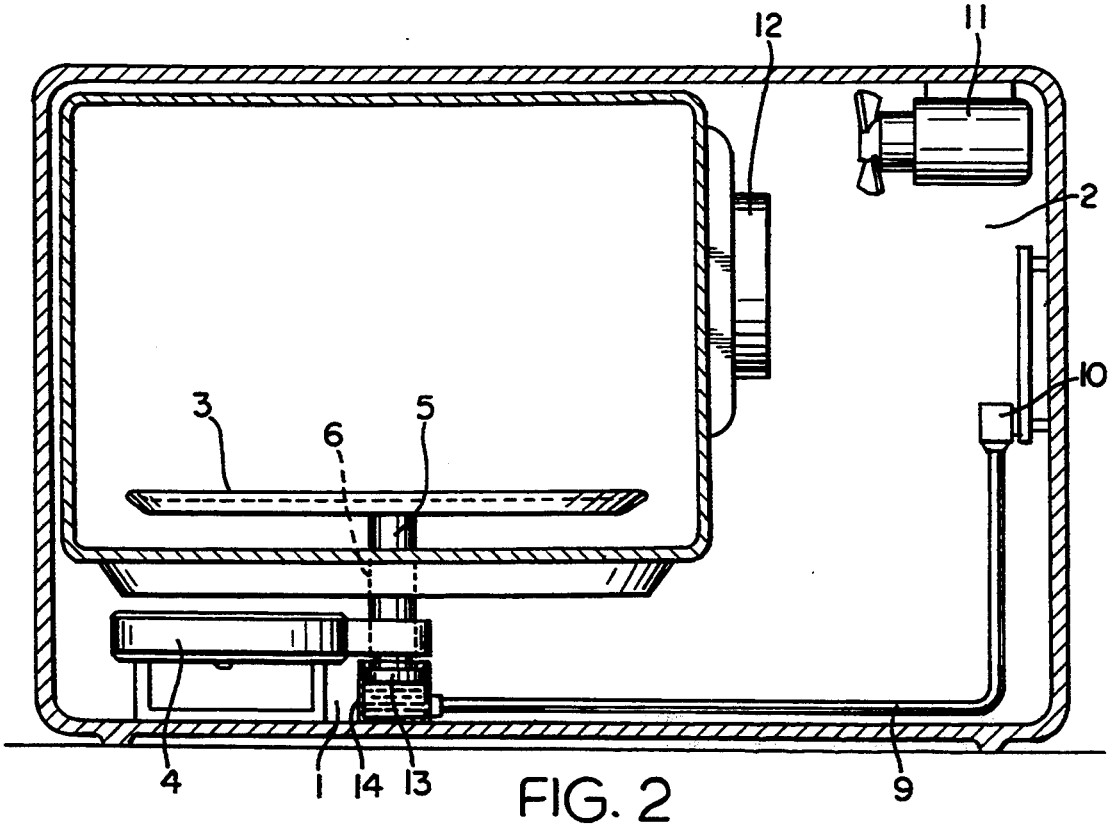
FIG. 2

MICROWAVE OVEN WITH TURNTABLE AND WEIGHT SENSOR

The present invention relates to a microwave oven comprising a cavity, a microwave source for supplying microwave energy into the cavity, and a weighing device for weighing a food product which has been placed in the cavity for cooking, and further comprising a plate provided at the cavity bottom for supporting the food product, a vertically movable shaft supporting the plate, said shaft being disposed underneath the plate and extending through an opening in the cavity bottom into a first space, said plate and said shaft being depressed by the weight of the food product when placed on the plate, and an electronic pressure sensor which is included in the weighing device and which converts a pressure change initiated by the food product and applied to a receiving part of the pressure sensor, into a signal indicating the weight of the food product.

To make it possible to control the cooking process in a microwave oven, use has been made of a weighing device, by means of which the cooking time and the power of the oven can be controlled by the weighing device sensing the change of weight of the food product during cooking. Many alternative solutions are known where the weighing device is arranged in basically the same manner, but where the constructional details differ from each other.

U.S. Pat. No. 4,895,067 describes a microwave oven which is provided with a device for weighing a food product which has been placed on a turntable. For the weighing, use is made of a weight sensor which, like the pertaining other electronic components according to this design, is disposed in the space below the cavity bottom. Microwave ovens of substantially the same design are known, for instance, from JP 62-221778, JP 63-33431 and JP 02-189712.

JP 62-59315 describes a microwave oven which is provided with a weighing device. This device consists of a U-shaped, resilient element which, through a shaft, is loaded by a food product. The U-shaped element in turn acts on the arm of a transducer adapted to convert the motion of the arm into a signal that can be related to the weight of the food product.

The known constructions all suffer from the drawback of the weighing device being located in the space below the cavity bottom, where the drive motor is also disposed in the case of a microwave oven having a turntable. This means that the electronic components included in the weighing device are situated in an unsuitable environment. Since the electronic components are temperature-sensitive, mounting them in the space below the cavity bottom is not advisable because the temperature may vary there by up to 100° C. Moreover, because of the hole provided for the shaft in the cavity bottom, there is also a risk that dirt, water or food waste, for instance, may penetrate down to the electronic components and cause damage to them. There is also a risk of microwave leakage, which may interfere with the operation of the electronic components. These deficiencies Give rise to incorrect measurement values, and steps must be taken to compensate for this, which means complex and expensive solutions. The construction according to JP 62-59315 is based on an old technique involving several mechanical components which require much space and which are not suited for present-day manufacturing methods.

The object of the invention is to provide a microwave oven having a weighing device which does not suffer from the above-mentioned drawbacks of prior-art technology, and which permits weighing a food product with high accuracy throughout the life of the oven and at lower costs.

According to the invention, this object is achieved by means of a microwave oven of the type mentioned in the introductory part, in which the pressure sensor is disposed in a second space separate from the first space, and in which a fluid-containing pressure container or pressure chamber is provided in said first space for taking up the weight of the food product and for generating and transmitting said pressure change to the receiving part of the pressure sensor.

The provision of the electronic components in the second space solves the problems of the prior-art constructions. Thus, there is provided a weighing device which does not rely on any electronic components in the space below the cavity bottom, these components being instead advantageously provided on circuit boards for the remaining electronics. The weighing device is further designed with few components, which means low costs and minimum space requirement. The risk that e.g. dirt, water and food waste which may penetrate down into the space below the cavity bottom, will cause damage to the electronic components has been entirely obviated. Moreover, the drawbacks of temperature sensitivity and microwave leakage are overcome by preferably disposing the electronic components in a microwave-free space, where the temperature is controlled by the cooling fan of the microwave oven. Thus, the weighing device operates according to the principle that the weight of the food product generates a pressure change in a "transducer part". This pressure change is then transmitted to a "receiving part" of a pressure sensor separate from the transducer part.

According to another embodiment of the invention, the weighing device is characterised in that said pressure container or pressure chamber comprises a fluid-containing bladder of flexible material. This confers the advantages of a simple and cost-saving manufacturing method, in that the bladder is in itself a simple component that can be manufactured at a low cost and is easy to handle during the assembly of the oven. If a short stroke length of the vertically movable shaft is desired, the fluid employed is preferably a liquid, which basically is non-compressible. This is however a more expensive solution than using e.g. an air-filled bladder.

According to yet another embodiment, the weighing device is characterised in that a transmission device is provided for transmitting the weight of the food product from said shaft to the pressure container or pressure chamber, and that the transmission device comprises a rocker arm, one end of which engages said shaft and the other end of which engages the flexible bladder, such that a vertical motion of the shaft produces a corresponding compression of the bladder. By suitably dimensioning the rocker arm, it is possible to obtain a leverage, such that the pressure changes in the pressure container will assume values within a desired range for the loads to be anticipated.

A further embodiment is characterised in that the transmission device and the pressure container or pressure chamber are provided by means of a fluid-containing piston and cylinder assembly, which is adapted to connect said shaft to said receiving part of the pressure sensor. This embodiment is an alternative way of implementing the weighing device, whereby to obtain the same advantages as in the embodiments mentioned above.

A still further embodiment is characterised in that the transmission device is implemented by the provision of the fluid-containing bladder below and in direct association with the vertically movable shaft. In this manner, a weighing device is obtained by the use of very few components.

In a microwave oven comprising a motor-driven turntable, yet another embodiment is characterised in that said plate for supporting the food product is implemented by means of the turntable, and that said vertically movable shaft is implemented by means of the rotary shaft of the turntable.

Embodiments of the invention will be described in more detail hereinbelow with reference to the accompanying drawings, in which FIG. 1 is a schematic sectional view of a microwave oven having a turntable and provided with the weighing device according to the invention;

FIG. 2 is a schematic sectional view of a microwave oven having a turntable and provided with a weighing device according to the invention. This Figure shows an alternative way of achieving a pressure signal which indicates the weight of the food product and which is transmitted to the pressure sensor.

FIG. 1 shows a microwave oven having a turntable, and a weighing device according to the present invention. For driving the turntable 3, use is made of a motor 4 which is disposed in the first space 1. The shaft 5 of the motor is extended through an opening 6 in the cavity bottom, the upper end of the shaft supporting the turntable 3. In this embodiment, the weighing device comprises a rocker arm 7, a fluid-containing bladder 8, a hose 9, and a pressure sensor 10. The rocker arm 7 is disposed below the motor 4, such that the lower end of the shaft 5 is in contact with one end of the rocker arm 7. The bladder 8 rests on the other end of the rocker arm. The bladder 8 comprises a hose 9, whose end is connected to the receiving part of the pressure sensor 10. When a food product is placed on the plate 3, the shaft 5 is depressed by the weight of the food product. The arrangement in the motor for enabling the vertical motion of the shaft is prior art, and is not comprised by the invention. When the position of the rocker arm is changed owing to the load exerted by the food product, the bladder is compressed, thus initiating a pressure change in the bladder. This pressure change is transmitted through the hose 9 to the receiving part of the pressure sensor 10. The pressure sensor 10 is preferably an electronic pressure sensor, which is mounted on the same circuit board as the remaining control electronics of the oven. The pressure sensor is sensitive to pressure changes applied to its receiving part, and can in this manner generate a signal indicating the weight of the food product. The cooling fan 11 cools the microwave source 12 and ensures that the temperature in the second space is maintained within permissible limits.

FIG. 2 shows an alternative way of providing a transmission of the vertical motion of the shaft to the pressure sensor, i.e. from a "transducer part" sensing the weight itself, to the receiving part of the pressure sensor when this is disposed in a space, here called the second space, which is separate from the space underneath the bottom of the cavity, here called the first space. Use is then made of a piston and cylinder assembly. The piston 13 is loaded by the weight of the food product through the shaft 5, such that the pressure in the fluid-containing cylinder 14 is changed. This pressure change is then applied to the pressure sensor, so as to obtain a signal indicating the weight of the food product.

I claim:

1. A microwave oven comprising a cavity, a microwave source for supplying microwave energy into the cavity, and a weighing device for weighing a food product which has been placed in the cavity for cooking, and further comprising a plate provided at the bottom of the cavity for supporting the food product, a vertically movable shaft supporting the plate, said shaft being disposed underneath the plate and extending through an opening in the cavity bottom into a first space, said plate and said shaft being depressed by the weight of the food product when placed on the plate, an electronic pressure sensor which is included in the weighing device and which converts a pressure change initiated by the food product and applied to a receiving part of the pressure sensor, into a signal indicating the weight of the food product, the pressure sensor is disposed at a distance from said first space in a second space subject to different climatic condition than said first space, and including a pressure chamber in said first space for taking up the weight exerted by the food product and for generating and transmitting said pressure change to the receiving part of the pressure sensor.

2. A microwave oven as claimed in claim 1, characterised in that said pressure chamber comprises a fluid-containing bladder of flexible material.

3. A microwave oven as claimed in claim 2 characterised in that the transmission device comprises a rocker arm, one end of which engages said shaft and the other end of which engages the flexible bladder, such that a vertical motion of the shaft produces a corresponding compression of the bladder.

4. A microwave oven as claimed in claim 2, characterised in that a transmission device is provided for transmitting the weight of the food product from said shaft to said or pressure chamber.

5. A microwave oven as claimed in claim 4, characterised in that the transmission device and the pressure chamber are provided by means of a fluid-containing piston and cylinder assembly, which is adapted to connect said shaft to said receiving part of the pressure sensor.

6. A microwave oven as claimed in claim 4, characterised in that the transmission device is implemented by the provision of the fluid-containing bladder below and in direct association with the vertically movable shaft.

7. A microwave oven as claimed in claim 1, comprising a motor-driven, turntable, characterised in that said plate for supporting the food product is implemented by means of the turntable, and that said vertically movable shaft is implemented by means of the rotary shaft of the turntable.

* * * * *